US009144979B2

(12) United States Patent
Yoshida et al.

(10) Patent No.: US 9,144,979 B2
(45) Date of Patent: Sep. 29, 2015

(54) LIQUID ABSORBING MATERIAL, CAP DEVICE AND LIQUID EJECTING APPARATUS

(75) Inventors: Atsushi Yoshida, Shiojiri (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 2151 days.

(21) Appl. No.: 12/178,221

(22) Filed: Jul. 23, 2008

(65) Prior Publication Data

US 2009/0027444 A1 Jan. 29, 2009

(30) Foreign Application Priority Data

Jul. 24, 2007 (JP) ..... 2007-192373

(51) Int. Cl.
*B41J 2/165* (2006.01)

(52) U.S. Cl.
CPC ..... *B41J 2/16523* (2013.01); *B41J 2/16532* (2013.01)

(58) Field of Classification Search
CPC .... B41J 2/165; B41J 2/16505; B41J 2/16508; B41J 2/16511; B41J 2/16523; B41J 2/16532
USPC ..... 347/29, 31
See application file for complete search history.

(56) References Cited

U.S. PATENT DOCUMENTS 6,896,352 B2 * 5/2005 Miyauchi ..... 347/30
7,566,115 B2 * 7/2009 Endo et al. ..... 347/55

FOREIGN PATENT DOCUMENTS

JP 11-157088 6/1999
JP 2004-223733 8/2004

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A liquid absorbing material, being provided in a liquid ejecting apparatus having a liquid ejecting head for ejecting liquid from nozzle openings formed on a nozzle forming surface, and being able to come into abutment with the liquid ejecting head so as to cover the nozzle openings and being stored in a cap having a discharge channel for discharging the liquid in the interior thereof, includes a body portion to be arranged in the cap when being stored in the cap, and a projecting portion arranged in the discharge channel.

9 Claims, 8 Drawing Sheets

LIQUID ABSORBING MATERIAL, CAP DEVICE AND LIQUID EJECTING APPARATUS

BACKGROUND

1. Technical Field

The present invention relates to a liquid ejecting apparatus such as an ink jet type printer, a cap device provided in the liquid ejecting apparatus, and a liquid absorbing material provided in the cap device.

2. Related Art

In general, as a liquid ejecting apparatus which ejects ink (liquid) from nozzle openings formed on a recording head (liquid ejecting head) onto a target, for example, an ink jet type printer (hereinafter, referred to simply as "printer") is widely known. In the printer of this type, so-called cleaning of the recording head is carried out for the purpose of restraining clogging of the nozzle openings by ink increased in viscosity and discharging ink containing air bubbles or dust from the nozzles of the recording head. The cleaning operation is adapted to suck and discharge viscous ink or ink containing air bubbles from the nozzle openings by sucking the content in a cap through a discharging portion of the cap in a state in which the cap is brought into abutment with the recording head so as to surround the nozzle openings. In the interior of the cap, an ink absorbing member (liquid absorbing material) for absorbing and holding part of ink sucked and discharged from the nozzle opening at the time of cleaning is stored.

As a printer provided with a cap in which an ink absorbing member is stored in the interior thereof, a printer described in JP-A-11-157088 is known. In the printer in JP-A-11-157088, an ink suction port (discharging portion) is provided so as to open through a bottom surface in a cap member (cap) and an ink absorbing member is stored in the cap member so as to cover the opening at the ink suction port.

In the printer disclosed in JP-A-11-157088, since a lower surface of the ink absorbing member which comes into surface contact with the bottom surface in the cap member is flat, when the interior of the cap member is sucked through the ink suction port, ink absorbed and held by the ink absorbing member can hardly be guided toward the ink suction port. Therefore, there arises a problem that the ink absorbed and held by the ink absorbing member can hardly be discharged from the ink suction port.

SUMMARY

An advantage of some aspects of the invention is that a liquid absorbing material, a cap device and a liquid ejecting apparatus which facilitate discharge of liquid absorbed and held in the liquid absorbing material is provided.

According to an aspect of the invention, there is provided a liquid absorbing material being provided in a liquid ejecting apparatus having a liquid ejecting head for ejecting liquid from nozzle openings formed on a nozzle forming surface, and being able to come into abutment with the liquid ejecting head so as to cover the nozzle openings and being stored in a cap having a discharge channel for discharging the liquid in the interior thereof, including a body portion to be arranged in the cap when being stored in the cap, and a projecting portion arranged in the discharge channel.

In this arrangement, since the liquid absorbed and held in the body portion is guided into the discharge channel by the projecting portion, the liquid absorbed and held in the liquid absorbing member is easily discharged.

Preferably, the projecting portion is arranged in a state of being fitted in the discharge channel.

In this arrangement, the liquid absorbed and held in the liquid absorbing material may be sucked and discharged efficiently by sucking the interior of the discharge channel from the outside of the cap.

Preferably, the projecting portion is adapted at least to be resiliently deformable, and to be inserted into the discharge channel in a compressed state.

In this arrangement, an inner surface of the discharge channel and the projecting portion may be brought into tight contact with each other.

A cap device according to an aspect of the invention includes the liquid absorbing material having the configuration as described above and a cap being able to store the liquid absorbing material therein, in which the cap includes a discharge channel for discharging liquid in the interior thereof, and a recessed groove extending toward the discharge channel on a bottom surface in the cap.

In this arrangement, the liquid staying on the bottom surface in the cap may be guided to the discharge channel by the recessed groove.

Preferably, the cap includes an atmosphere opening channel for opening the interior of the cap to the atmosphere and the recessed groove extends from the atmosphere opening channel toward the discharge channel.

In this arrangement, by sucking the interior of the discharge channel from the outside of the cap, the liquid staying on the bottom surface in the cap may be desirably guided from the atmosphere opening channel side toward the discharge channel side by the recessed groove. Since the atmospheric air flows in the recessed groove from the atmosphere opening channel side toward the discharge channel side, bubbling of the liquid is restrained and, even though the liquid is bubbled, the bubbled liquid may be guided from the atmosphere opening channel side toward the discharge channel side quickly by the recessed groove.

Preferably, the discharge channel and the atmosphere opening channel are arranged on a side portion of the cap so as to oppose to each other, and the atmosphere opening channel is connected linearly to an end portion of the recessed groove on the side of the atmosphere opening channel in a communicating state.

In this arrangement, the atmospheric air from the interior of the atmosphere opening channel may easily enter the recessed groove.

Preferably, a shoulder is provided between the bottom surface in the discharge channel and the bottom surface in the cap so that the bottom surface in the discharge channel is higher than the bottom surface in the cap.

In this arrangement, since the projecting portion of the liquid absorbing material comes into press contact with the bottom surface in the discharge channel, adhesiveness between the projecting portion of the liquid absorbing material and the bottom surface in the discharge channel may be enhanced.

Preferably, the shoulder is adjacent to an end portion of the recessed groove on the discharge channel side.

In this arrangement, since the end portion of the recessed groove on the discharge channel side is closed by the shoulder, the atmospheric air flowing from the interior of the atmosphere opening channel into the recessed groove is prevented from flowing directly into the discharge channel.

A liquid ejecting apparatus including a liquid ejecting head for ejecting liquid and a cap device having the configuration as described above.

In this arrangement, the same effect and advantages as the cap device having the configuration as described above are achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
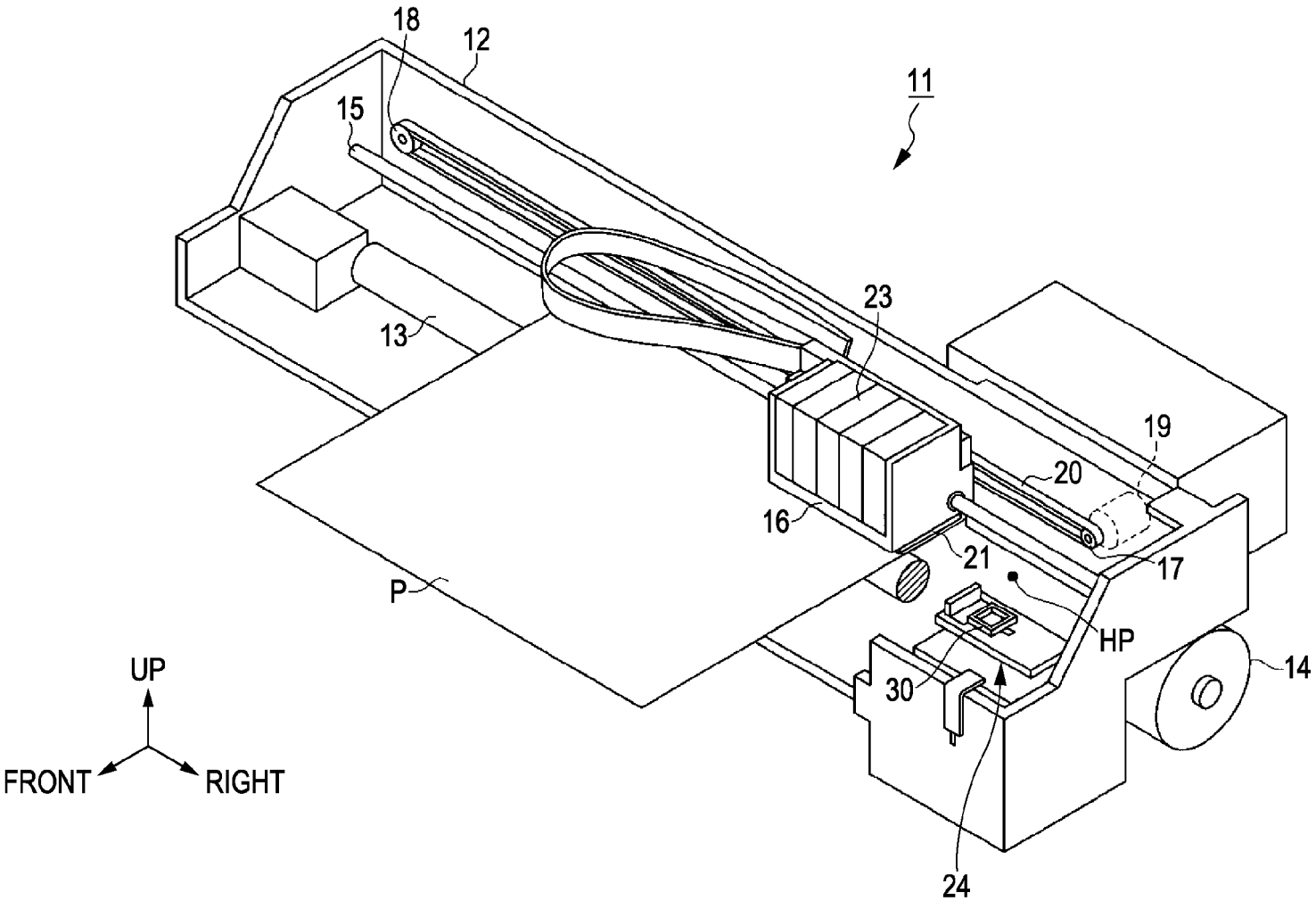
FIG. 1 is a perspective view showing an ink jet type printer according to an embodiment.

Referring now to the drawings, an embodiment in which a liquid ejecting apparatus according to an aspect of the invention is applied to an ink jet type printer will be described. In the description shown below, "fore-and-aft direction", "vertical direction" and "lateral direction" match "fore-and-aft direction", "vertical direction" and "lateral direction" with reference to FIG. 1.

As shown in FIG. 1, an ink jet type printer 11 which corresponds to a liquid ejecting apparatus includes a frame 12 formed into a rectangular shape in plan view. Extending in the lateral direction in the frame 12 is a platen 13, so that a recording paper P is fed onto the platen 13 from the rear side to the front side by a paper feeding mechanism having a paper feeding motor 14. Provided in the frame 12 above the platen 13 is a guide shaft 15 which extends in parallel with the longitudinal direction (lateral direction) of the platen 13.

A carriage 16 is supported by the guide shaft 15 so as to be capable of reciprocating along the axial direction of the guide shaft 15 (lateral direction). A drive pulley 17 and a driven pulley 18 are rotatably supported on a rear surface in the frame 12 at positions corresponding to both ends of the guide shaft 15. A carriage motor 19 which corresponds to a drive source when reciprocating the carriage 16 is connected to the drive pulley 17, and a timing belt 20 which fixes and supports the carriage 16 is wound around the pair of pulleys 17, 18. Therefore, the carriage 16 is adapted to be moved in the lateral direction via the timing belt 20 by being guided by the guide shaft 15 when the carriage motor 19 is driven.

Figure 3:
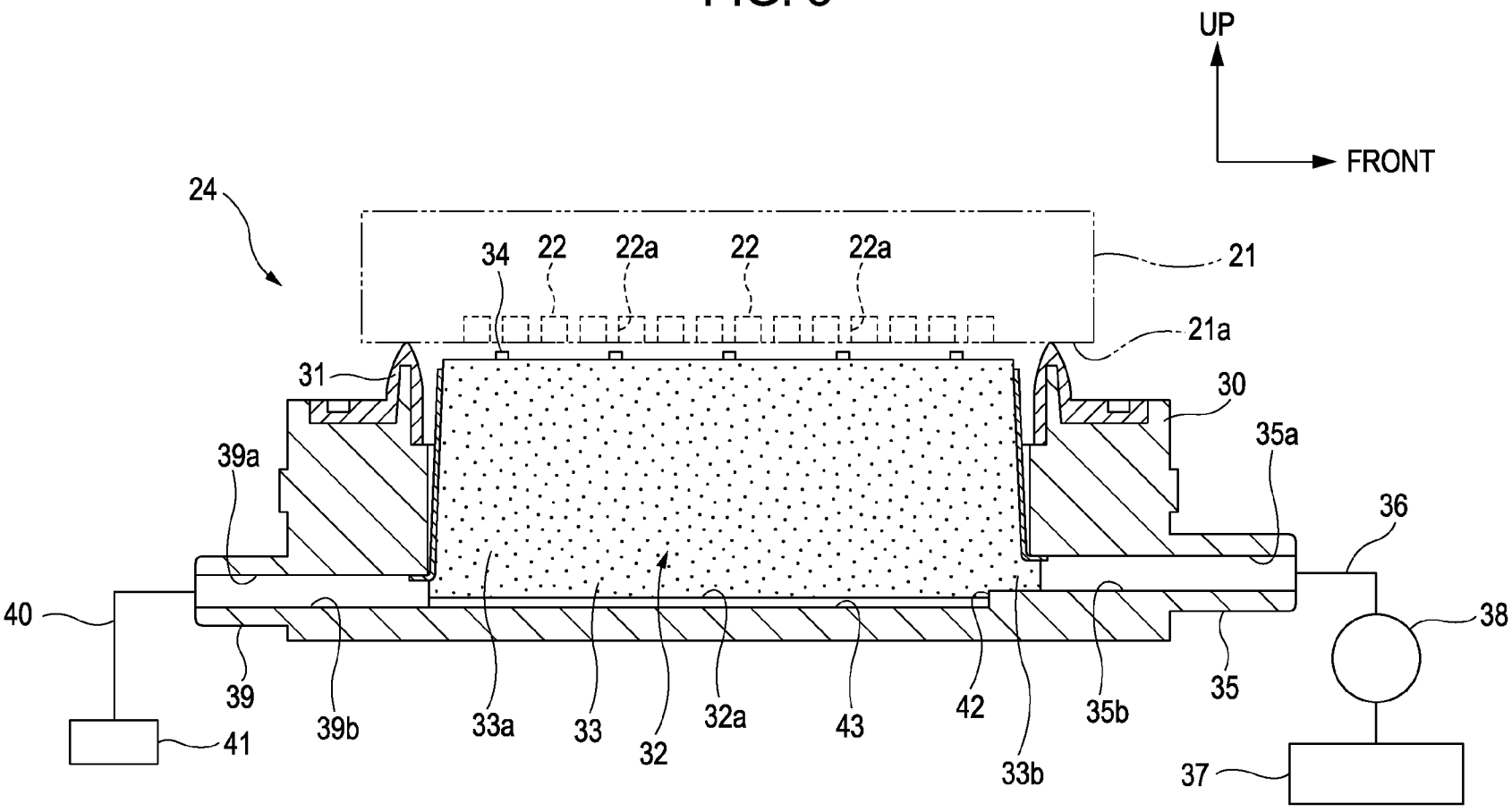
FIG. 3 is an enlarged cross-sectional view showing a principal portion of a maintenance unit of the same printer.

A recording head 21 which corresponds to a liquid ejecting head is provided on a lower surface of the carriage 16. As shown in FIG. 3, nozzle openings 22*a* of a nozzle group including a plurality of nozzles 22 arranged in rows are formed on a nozzle formed surface 21*a* which is defined by the lower surface of the recording head 21 so as to form a plurality (five in this embodiment) of nozzle rows along the fore-and-aft direction at constant pitches in the lateral direction.

On the other hand, as shown in FIG. 1, a plurality of (five in this embodiment) ink cartridges 23 for supplying ink which corresponds to liquid to the recording head 21 are demountably mounted to the carriage 16. The respective ink cartridges 23 correspond independently to the respective nozzle rows formed on the nozzle formed surface 21*a* of the recording head 21, and each are adapted to supply ink to the nozzle group of the corresponding nozzle row via an ink channel, not shown, formed in the recording head 21.

A home position HP which corresponds to a maintenance position for causing the carriage 16 to position when the power source of the ink jet type printer 11 is off, or when carrying out a maintenance of the recording head 21 is provided at an end portion in the frame 12 (right end portion in FIG. 1), that is, in a non-printing area where the recording paper P does not reach. A maintenance unit 24 which carries out various maintenance operations is provided at a position below the home position HP for maintaining ink ejection to the recording paper P from the recording head 21 to be achieved desirably.

A detailed configuration of the maintenance unit 24 will be described.

Figure 2:
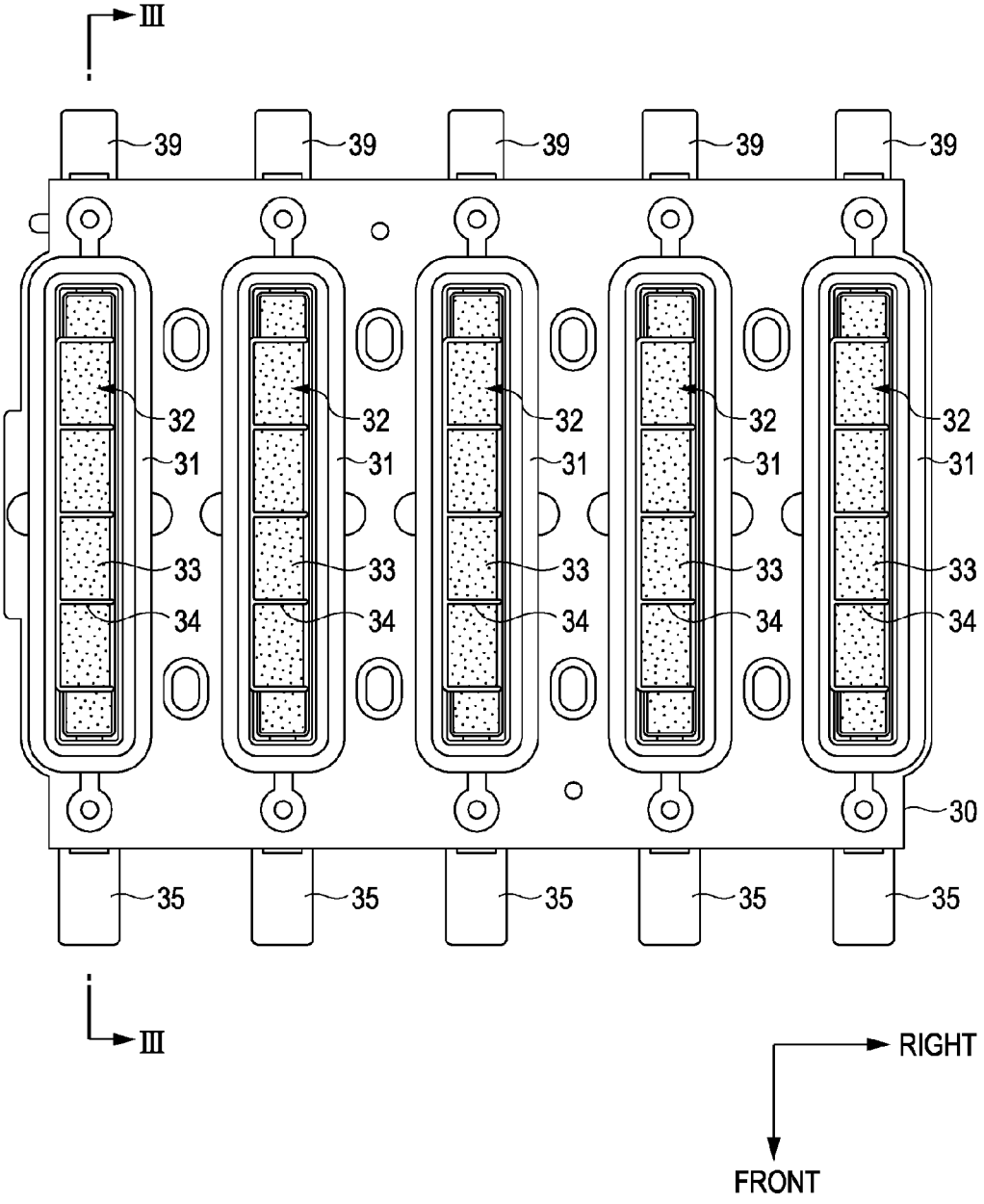
FIG. 2 is a plan view showing a cap of the same printer.

As shown in FIG. 2 and FIG. 3, the maintenance unit 24 includes a cap 30 being formed into substantially a rectangular box shape and being formed with a plurality (five in this embodiment) of seal portions 31 each having a rounded rectangular shape so as to constitute cap opening portions and corresponding independently to the each nozzle row formed on the nozzle formed surface 21*a* of the recording head 21 on the upper surface side of the cap 30.

A cap small chamber 32 is formed so as to be depressed inside the each respective seal portion 31 on the upper surface of the cap 30, and an ink absorbing member 33 which corresponds to a liquid absorbing member is mounted to the each cap small chamber 32 in a state in which the ink absorbing member 33 is held by an attachment 34. The ink absorbing member 33 is formed of flexible porous material, and is adapted to absorb and hold ink discharged from the nozzle openings 22*a* of the respective nozzle rows. In this embodiment, the cap device includes the cap 30 and the respective ink absorbing members 33.

The maintenance unit 24 includes an elevating device (not shown) for elevating the cap 30. When the cap 30 is moved upward by the elevating device (not shown) in a state in which the carriage 16 is moved to the home position HP, an upper end of the each sealing portion 31 is brought into tight contact with the nozzle formed surface 21*a* of the recording head 21, and the each nozzle row is independently covered by the cap 30.

Discharge channel formed portions 35 for forming discharge channels 35*a* for discharging ink in the interior of the respective cap small chambers 32 are formed at lower ends on the front sides of the respective cap small chambers 32 of the cap 30 so as to extend in the fore-and-aft direction, and the front end portions of the discharge channel formed portions 35 project forward with respect to the front surface of the cap 30. Proximal sides (upstream sides) of discharge tubes 36 formed of flexible material are connected to the front end portions of the respective discharge channel formed portions 35, and the interiors of the respective cap small chambers 32 and the interiors of the respective discharge tubes 36 are communicated with each other via the respective discharge channels 35*a*.

The respective discharge tubes 36 are joined into one at a midpoint on the way to distal end sides (downstream sides) of the respective discharge tubes 36, and the distal end side (downstream side) of the joined portion of the discharge tubes 36 is inserted into a waste ink tank 37. A suction pump 38 for sucking the interior of the discharge tubes 36 from the cap 30 side toward the waste ink tank 37 side is disposed at a midpoint of the discharge tube 36 on the downstream side of the joint point of the respective discharge tubes 36. When the suction pump 38 is driven, the interiors of the respective cap small chambers 32 are sucked via the discharge tubes 36 and the discharge channels 35*a*.

Atmosphere opening channel formed portions 39 which define atmosphere opening channels 39*a* for opening the interior of the cap small chambers 32 to the atmosphere extend in the fore-and-aft direction at lower end portions on the rear side of the cap small chambers 32 of the cap 30, and the rear end portions of the respective atmosphere opening channel formed portions 39 project rearward with respect to the rear surface of the cap 30. Therefore, the cap 30 is formed with the discharge channel formed portions 35 and the atmosphere opening channel formed portions 39 so as to oppose to each other in the fore-and-aft direction.

Proximal ends of atmosphere opening tubes 40 formed of flexible material are connected to the rear end portions of the atmosphere opening channel formed portions 39, and the interiors of the cap small chambers 32 and the interiors of the respective atmosphere opening tubes 40 are communicated with each other via the respective atmosphere opening channels 39*a*. The atmosphere opening tubes 40 are joined into one at a midpoint on the way to distal end sides of the respective atmosphere opening tubes 40, and the distal end side of the joined portion of the atmosphere opening tubes 40 is provided with an atmosphere opening valve 41. Therefore, when the atmosphere opening valve 41 is opened, the interiors of the atmosphere opening tubes 40 are brought into communication with the atmosphere, and when the atmosphere opening valve 41 is closed, the interiors of the atmosphere opening tubes 40 are brought into non-communication with the atmosphere.

Figure 4A:
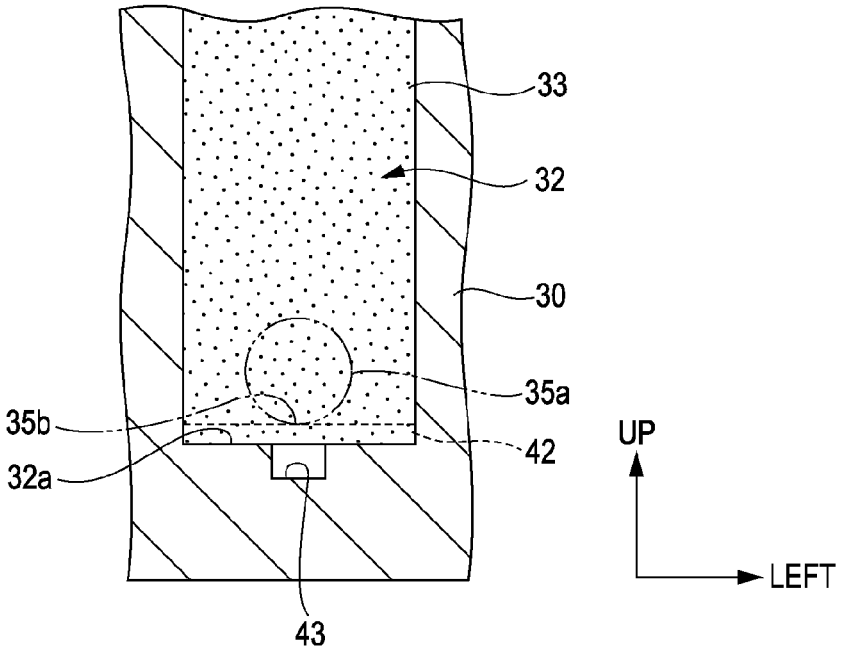
FIG. 4A is an enlarged cross-sectional view showing a positional relation among a discharge channel, a shoulder and a recessed groove.
Figure 4B:
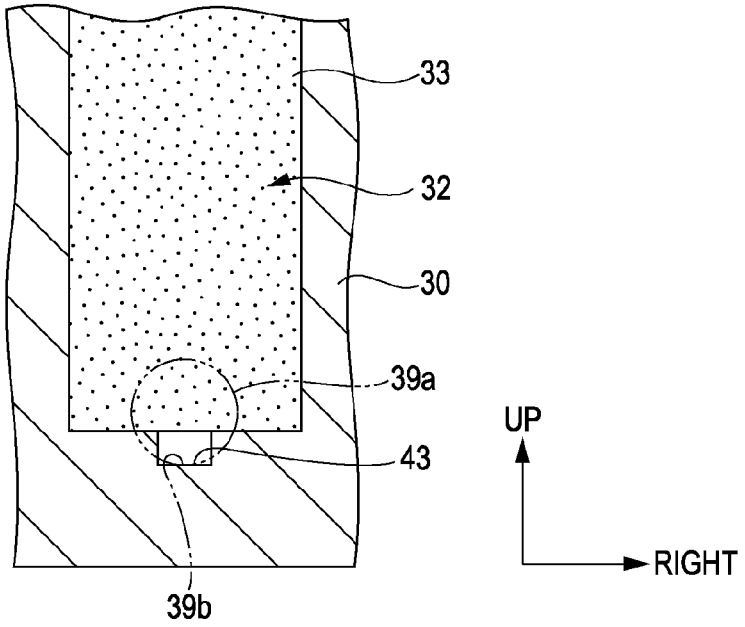
FIG. 4B is an enlarged cross-sectional view showing a principal portion of the positional relation between an atmosphere opening channel and the recessed groove.
Figure 5:
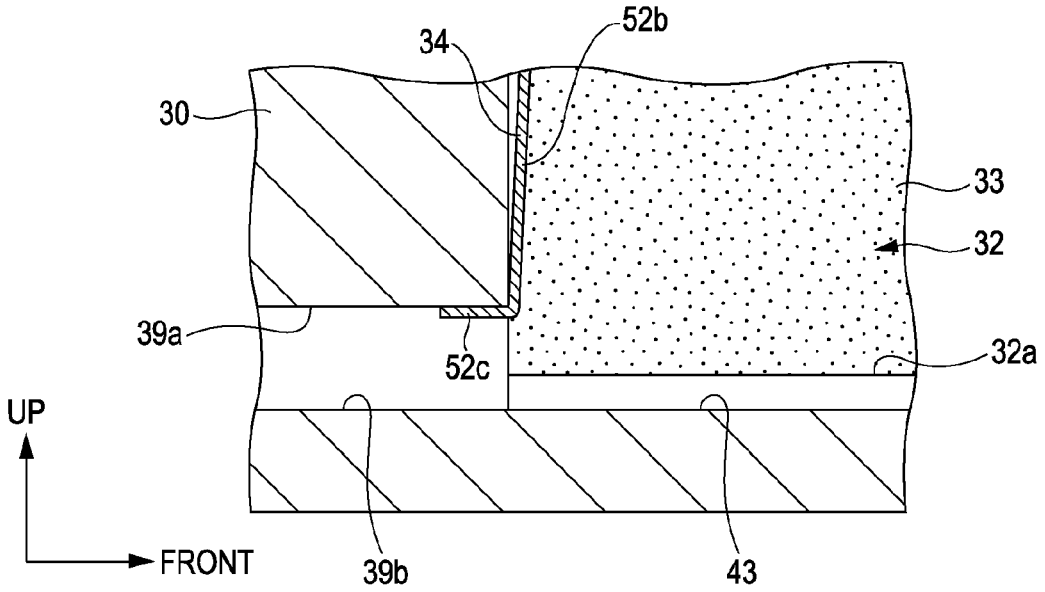
FIG. 5 is an enlarged view showing a principal portion of FIG. 3.
Figure 6:
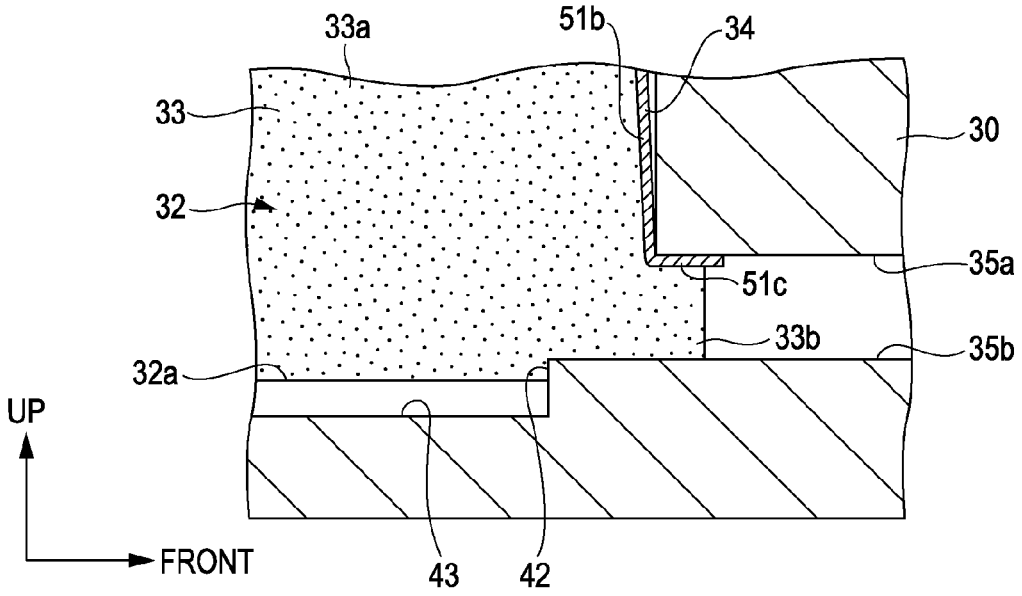
FIG. 6 is an enlarged view showing the principal portion of FIG. 3.

As shown in FIG. 3, FIG. 4A and FIG. 6, a shoulder 42 is provided between a bottom surface 32*a* in the each cap small chamber 32 and a lower end surface 35*b* of the each discharge channel 35*a* (the bottom surface in the each discharge channel formed portion 35) so that the lower end surface 35*b* is higher than the bottom surface 32*a*. The bottom surface 32*a* in the each cap small chamber 32 is formed with a recessed groove 43 so as to extend from the atmosphere opening channel formed portion 39 to the discharge channel formed portion 35. In other words, the rear end of the recessed groove 43 is connected linearly to the atmosphere opening channel 39*a* in a communicating state, and the front end thereof is adjacent to the shoulder 42. As shown in FIG. 3, FIG. 4B and FIG. 5, the bottom surface of the recessed groove 43 and the lower end surface 39*b* of the atmosphere opening channel 39*a* (the bottom surface in the atmosphere opening channel formed portion 39) are at substantially the same level.

Subsequently, the configuration of the ink absorbing member 33 and the attachment 34 will be described.

Figure 7:
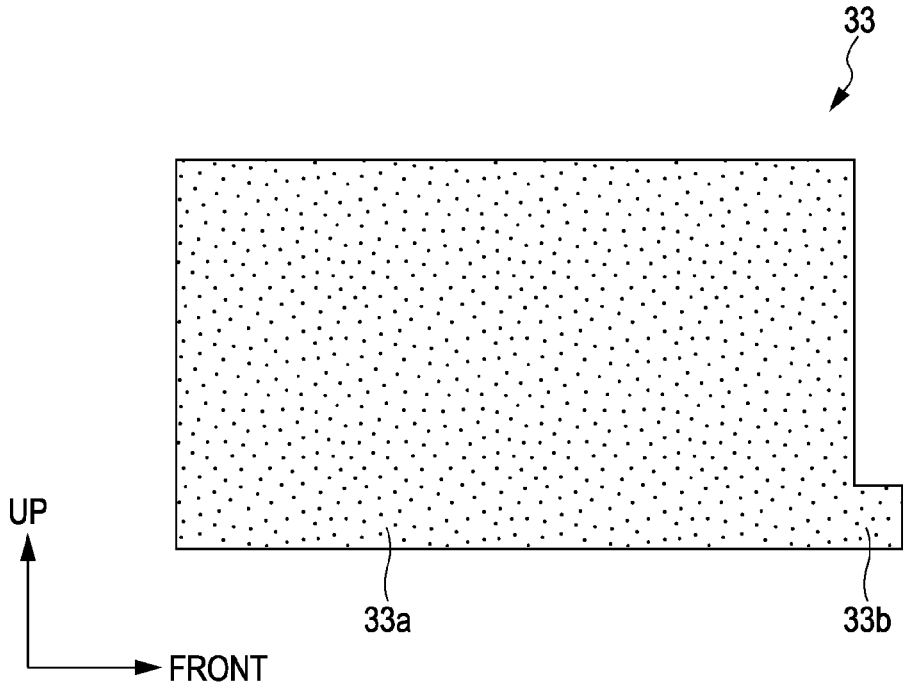
FIG. 7 is a side view showing an ink absorbing member according to the embodiment.

As shown in FIG. 7, the ink absorbing member 33 includes a body portion 33*a* formed into a rectangular prism shape and a projecting portion 33*b* formed into a square pole shape projecting from the lower end portion on the front surface of the body portion 33*a* toward the front. When the ink absorbing member 33 is mounted (stored) in the interior of the cap small chamber 32, the body portion 33*a* is arranged in the cap small chamber 32, and the projecting portion 33*b* is arranged in the discharge channel 35*a* in a fitted state.

In other words, the shape of the body portion 33*a* corresponds to the shape in the interior of the cap small chamber 32, and the width in the vertical direction and the width in the lateral direction of the projecting portion 33*b* are set to be slightly larger than the inner diameter of the discharge channel 35*a*. The lower surface of the body portion 33*a* and the lower surface of the projecting portion 33*b* each are a flat surface extending in parallel with the horizontal surface, and the lower surface of the body portion 33*a* and the lower surface of the projecting portion 33*b* are flush with each other.

Figure 8:
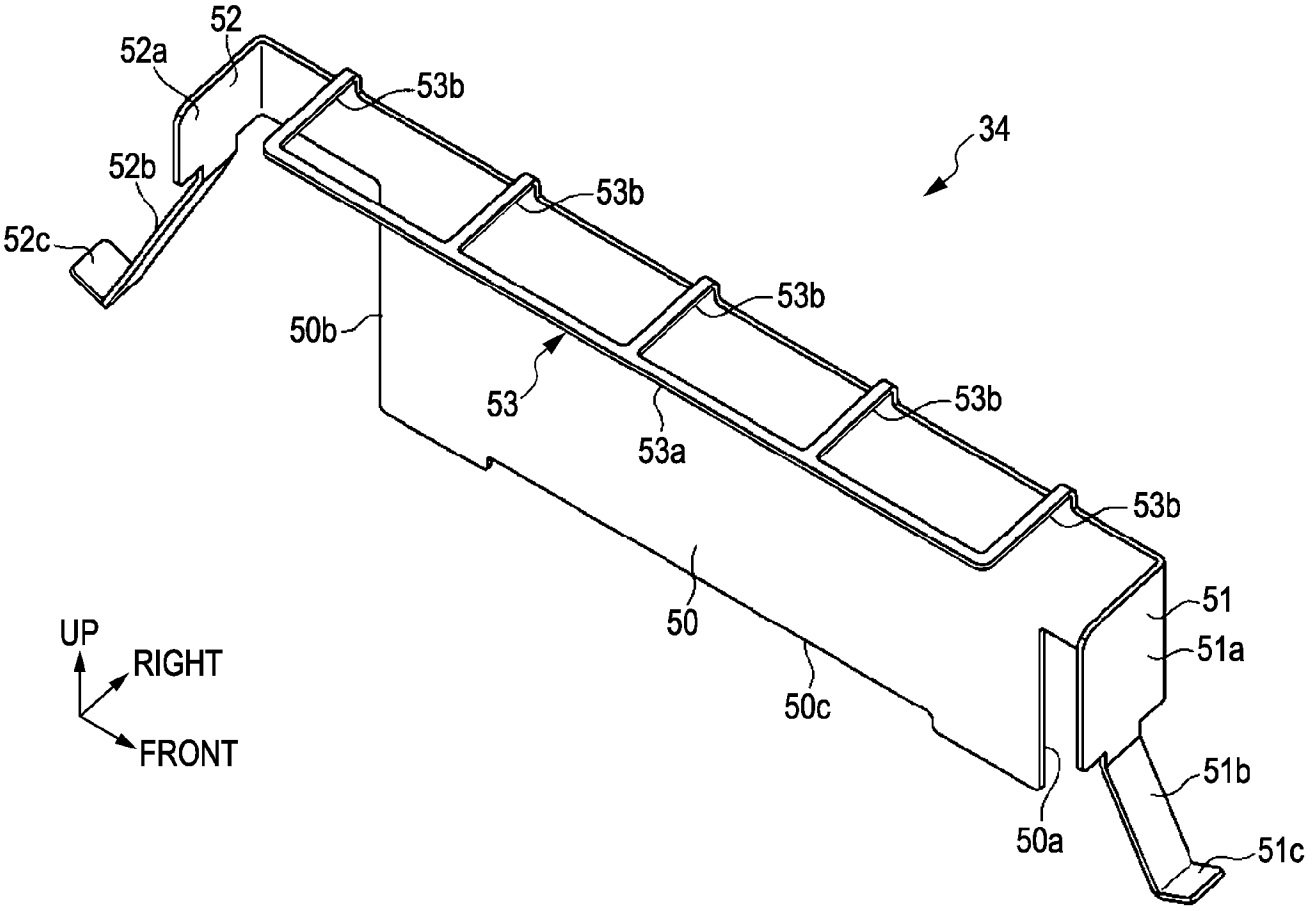
FIG. 8 is a perspective view showing an attachment according to the embodiment.
Figure 9:
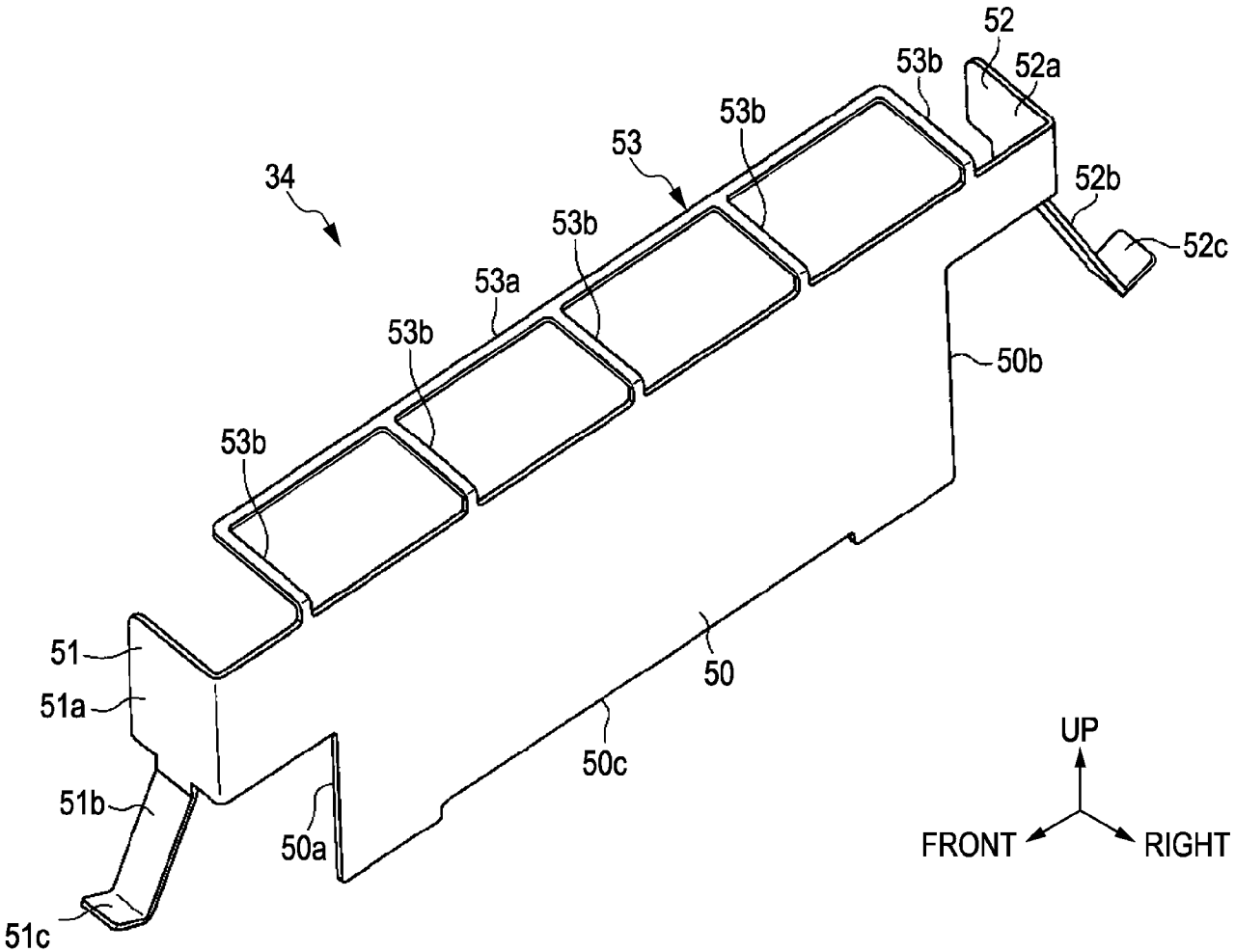
FIG. 9 is a perspective view showing the attachment according to the embodiment.

As shown in FIG. 8 and FIG. 9, the attachment 34 is formed of metal which does not rust easily, such as stainless steel, and includes a rectangular plate shaped substrate 50 elongated in the fore-and-aft direction. The substrate 50 is formed with a front notch 50*a* formed by removing a rectangular shape at a portion of the front end portion thereof from the substantially center to the lower end in the vertical direction, and is formed with a rear notch 50*b* formed by removing a rectangular shape at a portion of the rear end portion thereof from a position near the upper end portion with respect to the vertically center to the lower end thereof. The substrate 50 is also formed with a notched recess 50*c* on a lower edge thereof at the center portion in the fore-and-aft direction.

The substrate 50 is formed with a front panel 51 which corresponds to a side plate formed by bending a front end portion other than the front notch 50*a* toward the left at a right angle, and a rear panel 52 which corresponds to a side panel formed by bending a rear end portion other than the rear notch 50*b* toward the left at a right angle.

The front panel 51 includes a rectangular plate shaped front base portion 51*a* and a first engaging portion 51*b* having resiliency as an engaging portion extending from the lateral center of the lower end thereof obliquely toward the lower front (outside). In other words, the first engaging portion 51*b* is formed by bending part of the front panel 51 toward the front (outside). The width of the first engaging portion 51*b* in the lateral direction is set to be narrower than the width of the front base portion 51*a* in the lateral direction, and a distal end portion (a lower end portion) of the first engaging portion 51*b* is provided with a first engaging strip 51*c* formed by bending the distal end portion of the first engaging portion 51*b* upward at a right angle. The size of the first engaging strip 51*c* is set to be a size which can be inserted into the discharge channel 35*a* of the cap 30.

On the other hand, the rear panel 52 includes a rectangular plate shaped rear base portion 52*a* and a second engaging portion 52*b* having resiliency as an engaging portion extending from the lateral center of the lower end thereof obliquely toward the lower rear (outside). In other words, the second engaging portion 52*b* is formed by bending part of the rear panel 52 toward the rear (outside). The width of the second engaging portion 52*b* in the lateral direction is set to be narrower than the width of the rear base portion 52*a* in the lateral direction, and a distal end portion (lower end portion) of the second engaging portion 52*b* is provided with a second engaging strip 52*c* formed by bending the distal end portion of the second engaging portion 52*b* upward at a right angle. The size of the second engaging strip 52*c* is set to be a size which can be inserted into the atmosphere opening channels 39*a* of the cap 30.

The front base portion 51*a* and the rear base portion 52*a* are opposed to each other with the intermediary of the substrate 50, and the vertical length of the front base portion 51*a* is longer than the vertical length of the rear base portion 52*a*. The substrate 50 is provided with a presser portion 53 formed into a rectangular frame shape elongated in the fore-and-aft direction in plan view so as to project from an upper edge thereof toward the left. In other words, the presser portion 53 includes a vertical frame 53*a* extending in parallel with the upper edge of the substrate 50, and five lateral frames 53*b* which connect the vertical frame 53*a* and the upper edge of the substrate 50. The lateral frames 53*b* are arranged equidistantly with each other in the fore-and-aft direction from the rear end to the front end of the vertical frame 53*a*.

A left edge of the presser portion 53, a left edge of the front base portion 51*a* and a left edge of the rear base portion 52*a* are positioned on the same plane. In other words, the widths of the presser portion 53, the front base portion 51*a* and the rear base portion 52*a* in the lateral direction are set to be the same, and are set to correspond to the width of the interior of the cap small chamber 32 in the lateral direction.

When the ink absorbing member 33 is engaged with the attachment 34 so that a right surface of the ink absorbing member 33 (body portion 33*a*) comes into surface contact with a left surface of the substrate 50, and the upper surface of the ink absorbing member 33 (body portion 33*a*) comes into surface contact with the lower surface of the presser portion 53, the ink absorbing member 33 (body portion 33*a*) is pinched between the front base portion 51*a* and the rear base portion 52*a*. In other words, the ink absorbing member 33 is held by the attachment 34. In this embodiment, a holding portion includes the substrate 50, the front base portion 51*a* and the rear base portion 52*a*.

The method of mounting the ink absorbing member 33 to the interior of the cap small chamber 32 using the attachment 34.

When the ink absorbing member 33 is mounted to the interior of the cap small chamber 32, the ink absorbing member 33 is engaged with the attachment 34 to cause the ink absorbing member 33 to be held by the attachment 34. Subsequently, in a state in which the ink absorbing member 33 is held by the attachment 34, the attachment 34 is inserted into the cap small chamber 32 together with the ink absorbing member 33 while bending the first engaging portion 51*b* and the second engaging portion 52*b* of the attachment 34 inward. Then, the first engaging portion 51*b* and the second engaging portion 52*b* of the attachment 34 receive pressure from the front side surface and the back side surface in the cap small chamber 32 and maintain in a state of being bent inward. At this time, the projecting portion 33*b* of the ink absorbing member 33 receives pressure from the front side surface in the cap small chamber 32 and bent upward, thereby assuming a compressed state.

In this state, when the attachment 34 is pushed to the inner end of the cap small chamber 32 together with the ink absorbing member 33, the lower end of the substrate 50 and the lower surface of the body portion 33*a* of the ink absorbing member 33 come into abutment with the bottom surface 32*a* in the cap small chamber 32. At this time, the first engaging portion 51*b* and the second engaging portion 52*b* which have been bent inward are restored to their original state by their own resilient restoration force, and hence the first engaging strip 51*c* of the first engaging portion 51*b* engages the discharge channel 35*a*, and the second engaging strip 52*c* of the second engaging portion 52*b* engages the atmosphere opening channels 39*a*.

Furthermore, the projecting portion 33*b* which has been in the compressed state is inserted into the discharge channel 35*a* and is restored to its original state by its own resilient restoration force, and hence is fitted to the discharge channel 35*a*. At this time, the lower surface of the projecting portion 33*b* of the ink absorbing member 33 comes into abutment with the lower end surface 35*b* of the discharge channel 35*a*, and the lower end surface 35*b* of the discharge channel 35*a* is located at a level higher than the bottom surface 32*a* in the cap small chamber 32 which the lower surface of the body portion 33*a* of the ink absorbing member 33 comes into abutment with by a distance corresponding to the height of the shoulder 42.

Therefore, the lower surface of the projecting portion 33*b* of the ink absorbing member 33 comes into abutment (press-contact) with the lower end surface 35*b* of the discharge channel 35*a* at a stronger force than abutment of the lower surface of the body portion 33*a* of the ink absorbing member 33 with respect to the bottom surface 32*a* in the cap small chamber 32. In this case, the lower surface of the projecting portion 33*b* of the ink absorbing member 33 is deformed by being pressed by the lower end surface 35*b* of the discharge channel 35*a* which corresponds to the lower surface of the projecting portion 33*b*.

Therefore, when the first engaging strip 51*c* of the first engaging portion 51*b* engages the discharge channel 35*a* and the second engaging strip 52*c* of the second engaging portion 52*b* engages the atmosphere opening channels 39*a*, so that the upward movement of the ink absorbing member 33 together with the attachment 34 is restrained. In other words, the ink absorbing member 33 is mounted and fixed to the interior of the cap small chamber 32 via the attachment 34.

Subsequently, an operation to suck and discharge excessive ink stored in the each cap small chamber 32 after the cleaning of the recording head 21 will be described.

Normally, when the cleaning of the recording head 21 is carried out, ink sucked through the each nozzle opening 22*a* is excessively stored in the cap small chamber 32 of the cap 30. Therefore, it is necessary to suck and discharge the excessive ink stored in the each cap small chamber 32 after the cleaning.

When carrying out the cleaning of the recording head 21, the cap 30 assumes a state such that the upper ends of the respective seal portions 31 are in tight contact with the nozzle formed surface 21*a* of the recording head 21 and cover the respective nozzle rows independently, and that the atmosphere opening valve 41 is closed. When sucking and discharging the excessive ink stored in the each cap small chamber 32 of the cap 30 after the cleaning of the recording head 21, the atmosphere opening valve 41 is firstly opened and the suction pump 38 is driven. Then, the interior of the cap small chamber 32 is sucked through the discharge channel 35*a*, and the atmospheric air flows into the cap small chamber 32 through the atmosphere opening channel 39*a*.

Accordingly, the ink absorbed and held by the ink absorbing member 33 is guided to the discharge channel 35*a* by the projecting portion 33*b*, and the ink is smoothly discharged form the discharge channel 35*a*. On the other hand, most part of the atmospheric air flowing into the cap small chamber 32 through the atmosphere opening channel 39*a* flows through the recessed groove 43 toward the discharge channel 35*a* side, and hence the ink stored in the recessed groove 43 flows toward the discharge channel 35*a* by the pressure of the atmospheric air. At this time, bubbling of the ink is restrained by the flow of the atmospheric air in the recessed groove 43. Also, even when the ink is bubbled, the bubbles are guided to the discharge channel 35*a* side via the recessed groove 43 together with the ink, and are quickly discharged.

The adhesiveness between the lower surface of the projecting portion 33*b* of the ink absorbing member 33 and the lower end surface 35*b* of the discharge channel 35*a* is enhanced by the shoulder 42, and the opening of the recessed groove 43 on the front end side is closed. Therefore, the atmospheric air flowing into the recessed groove 43 from the atmosphere opening channels 39*a* does not flow directly to the discharge channel 35*a*. Therefore, lowering of the sucking efficiency in the cap small chamber 32 from the discharge channel 35*a* by the suction pump 38 is restrained, and hence the ink in the cap small chamber 32 is efficiently sucked and discharged from the discharge channel 35*a*.

When there exists a clearance between the lower surface of the projecting portion 33*b* of the ink absorbing member 33 and the lower end surface 35*b* of the discharge channel 35*a*, the atmospheric air flowing into the recessed groove 43 from the atmosphere opening channels 39*a* escapes through this clearance directly to the discharge channel 35*a*, so that the efficiency to suck the ink absorbed and held in the ink absorbing member 33 is lowered.

According to the embodiment described in detail, the following advantages are achieved.

(1) By inserting the attachment 34 into the cap small chamber 32 in a state in which the ink absorbing member 33 is held by the attachment 34, the first engaging strip 51*c* of the first engaging portion 51*b* of the attachment 34 engages the discharge channel 35*a* (discharge channel formed portions 35) and the second engaging strip 52*c* of the second engaging portion 52*b* engages the atmosphere opening channels 39*a* (atmosphere opening channel formed portions 39). Therefore, a mounting operation of the ink absorbing member 33 into the cap small chamber 32 is easily achieved by mounting the ink absorbing member 33 into the cap small chamber 32 via the attachment 34.

When the ink absorbing member 33 is thin and small, the ink absorbing member 33 is apt to be deformed when inserting the ink absorbing member 33 into the cap small chamber 32. Therefore, the mounting operation of the ink absorbing member 33 into the cap small chamber 32 may become complicated. As regards this point, according to this embodiment, even when the ink absorbing member 33 is thin and small, the ink absorbing member 33 is hardly deformed when inserting the ink absorbing member 33 into the cap small chamber 32 by inserting the ink absorbing member 33 into the cap small chamber 32 in the state in which the ink absorbing member 33 is held by the attachment 34. Therefore, even when the ink absorbing member 33 is thin and small in particular, the mounting operation of the ink absorbing member 33 into the cap small chamber 32 is easily achieved.

(2) The first engaging strip 51*c* of the first engaging portion 51*b* and the second engaging strip 52*c* of the second engaging portion 52*b* of the attachment 34 are configured to engage the discharge channel 35*a* (discharge channel formed portions 35) and the atmosphere opening channels 39*a* (atmosphere opening channel formed portions 39) which already exist in the cap 30. Therefore, it is not necessary to provide a recess or a hole for engaging respectively the first engaging strip 51*c* and the second engaging strip 52*c* of the attachment 34 additionally on the cap 30 side.

(3) The first engaging strip 51*c* of the first engaging portion 51*b* and the second engaging strip 52*c* of the second engaging portion 52*b* of the attachment 34 are configured to engage the discharge channel 35*a* (discharge channel formed portions 35) and the atmosphere opening channels 39*a* (atmosphere opening channel formed portions 39) arranged so as to oppose to each other with the intermediary of the cap small chamber 32 in the cap 30. Therefore, the attachment 34 holding the ink absorbing member 33 may be mounted into the cap small chamber 32 in a stable state without necessity to carry out a complicated thermal caulking process as disclosed in JP-A-2000-62202.

(4) The holding portion of the attachment 34 for holding the ink absorbing member 33 includes the substrate 50 which is able to come into surface contact with the ink absorbing member 33, and the front base portion 51*a* and the rear base portion 52*a* which are formed by bending at the front and rear ends of the substrate 50 so as to be capable of pinching the ink absorbing member 33 therebetween. Therefore, the ink absorbing member 33 is held reliably and firmly by the attachment 34.

(5) The first engaging portion 51*b* and the second engaging portion 52*b* of the attachment 34 are formed by bending part of the front panel 51 and the rear panel 52 respectively outward, and hence the configuration of the first engaging portion 51*b* and the second engaging portion 52*b* may be simplified. In other words, the first engaging portion 51*b* and the second engaging portion 52*b* may be formed easily.

(6) Since the attachment 34 is provided with the presser portion 53, when the ink absorbing member 33 is mounted into the cap small chamber 32 via the attachment 34, lifting of the ink absorbing member 33 in the cap small chamber 32 is effectively restrained.

(7) The ink absorbing member 33 includes, when being stored in the cap small chamber 32, the body portion 33*a* to be arranged in the cap small chamber 32 and the projecting portion 33*b* to be arranged in the discharge channel 35*a*. Therefore, by sucking the interior of the cap small chamber 32 by the suction pump 38 from the discharge channel 35*a*, the excessive ink absorbed and held by the body portion 33*a* is guided into the discharge channel 35*a* by the projecting portion 33*b*, so that the excessive ink absorbed and held by the body portion 33*a* (ink absorbing member 33) is easily sucked and discharged. In other words, the excessive ink in the cap small chamber 32 is smoothly sucked and discharged out of the cap small chamber 32 by the suction pump 38 via the discharge channel 35*a*.

(8) Since the projecting portion 33*b* of the ink absorbing member 33 is arranged in the state of being fitted to the discharge channel 35*a*, when the interior of the discharge channel 35*a* is sucked by the suction pump 38 from the outside the cap 30, suction loss due to the suction pump 38 is reduced. Therefore, the excessive ink absorbed and held in the body portion 33*a* (ink absorbing member 33) is efficiently sucked and discharged by the suction pump 38 via the discharge channel 35*a*.

(9) Since the projecting portion 33*b* of the ink absorbing member 33 has a flexibility and is inserted into the discharge channel 35*a* in the compressed state, the outer surface of the projecting portion 33*b* may be brought into tight contact with the inner peripheral surface of the discharge channel 35*a*.

(10) The recessed groove 43 extending from the atmosphere opening channels 39*a* to the discharge channel 35*a* is formed on the bottom surface 32*a* in the cap small chamber 32. Therefore, the excessive ink staying on the bottom surface 32*a* in the cap small chamber 32 may be desirably guided from the atmosphere opening channels 39*a* side to the discharge channel 35*a* side via the recessed groove 43 by sucking the interior of the cap small chamber 32 from the discharge channel 35*a*. In this case, bubbling of the ink is restrained by the flow of the atmospheric air in the recessed groove 43 from the atmosphere opening channels 39*a* side to the discharge channel 35*a* side, and even when the ink is bubbled, the bubbled ink is quickly guided by the recessed groove 43 from the atmosphere opening channels 39*a* side to the discharge channel 35*a* side.

(11) Since the atmosphere opening channels 39*a* is linearly connected to the rear end portion of the recessed groove 43 in the communicating state, the atmospheric air from the atmosphere opening channels 39*a* is easily entered into the recessed groove 43 (cap small chamber 32). In other words, the resistance generated when the atmospheric air from the atmosphere opening channels 39*a* flows into the recessed groove 43 is reduced, and hence smooth flow of the atmospheric air from the atmosphere opening channels 39*a* into the recessed groove 43 is achieved.

(12) There is provided the shoulder 42 between the lower end surface 35*b* of the discharge channel 35*a* and the bottom surface 32*a* in the cap small chamber 32 in such a manner that the lower end surface 35*b* is positioned at a higher level than the bottom surface 32*a*. Therefore, when the ink absorbing member 33 is stored in the cap small chamber 32, the projecting portion 33*b* of the ink absorbing member 33 comes into press contact with the lower end surface 35*b* of the discharge channel 35*a*, so that the adhesiveness between the projecting portion 33*b* of the ink absorbing member 33 and the lower end surface 35*b* of the discharge channel 35*a* is enhanced.

(13) Since the shoulder 42 is adjacent to the front end portion of the recessed groove 43, the front end portion of the recessed groove 43 is closed by the shoulder 42. Therefore, the atmospheric air flowed from the atmosphere opening channels 39*a* into the recessed groove 43 is prevented from flowing into the discharge channel 35*a* directly.

Modification

The embodiment may be modified as follows.

One of the first engaging portion 51*b* and the second engaging portion 52*b* may be omitted from the attachment 34.

The first engaging portion 51*b* and the second engaging portion 52*b* of the attachment 34 do not necessarily have to engage the discharge channel 35*a* and the atmosphere opening channels 39*a* respectively, and a recess or a hole for engaging the first engaging portion 51*b* and the second engaging portion 52*b* may be provided additionally on the cap 30 side.

The front end portion of the recessed groove 43 and the shoulder 42 do not necessarily have to be adjacent to each other. In other words, the front end portion of the recessed groove 43 and the shoulder 42 may be apart from each other.

The shoulder 42 may be omitted.

In the cap 30, the discharge channel formed portions 35 and the atmosphere opening channel formed portions 39 may be provided on the lower side of the cap small chamber 32 so as to face downward. In this case, the first engaging portion 51*b* and the second engaging portion 52*b* of the attachment 34 engage the ends (lower end portions) of the discharge channel formed portions 35 and the atmosphere opening channel formed portions 39 respectively on the opposite side from the cap small chamber 32.

In the cap 30, the recessed groove 43 and the atmosphere opening channels 39*a* do not necessarily have to be connected linearly. In other words, the atmosphere opening channels 39*a* may be connected to the recessed groove 43 from the intersecting direction.

The recessed groove 43 may be provided on the bottom surface 32*a* in the cap small chamber 32 so as to extend from the direction other than the atmosphere opening channel formed portions 39 side toward the discharge channel formed portions 35.

In the cap 30, the recessed groove 43 may be omitted.

In the cap 30, the atmosphere opening channel formed portions 39 (atmosphere opening channels 39*a*) may be omitted. In this case, the attachment 34 engages the discharge channel 35*a* only by the first engaging portion 51*b*.

The projecting portion 33*b* of the ink absorbing member 33 may be configured so as to be arranged in the discharge channel 35*a* in a loosely fitted state.

In the embodiment shown above, the liquid ejecting apparatus is applied to the ink jet type printer 11. However, it may be applied to a liquid ejecting apparatus which ejects liquid other than ink (liquid state material obtained by dispersing or mixing particles of functional material in liquid, fluid state material such as gel are also included). The "liquid" in this specification includes the liquid state material and the fluid state material as well as, for example, inorganic solvent, organic solvent, liquid solution, fluid resin, liquid metal (melted metal) and so on.

The entire disclosure of Japanese Patent Application No. 2007-192373, filed Jul. 24, 2007 is expressly incorporated by reference herein.

What is claimed is:

1. A cap device provided in a liquid ejecting apparatus having a liquid ejecting head for ejecting liquid from nozzle openings formed on a nozzle forming surface, the cap device comprising:

a seal portion that is configured to come into abutment with the liquid ejecting head so as to cover the nozzle openings of the nozzle formation surface;

a discharge channel for discharging liquid in the interior of the cap;

an atmosphere opening channel for opening the interior of the cap to the atmosphere;

a recessed groove extending toward the discharge channel on a bottom surface in the cap device, wherein the recessed groove is connected to the atmosphere opening channel and extending from the atmosphere opening channel toward the discharge channel, wherein the bottom surface of the cap device includes a step portion that causes the bottom surface of the cap device and the recessed groove to be lower than a bottom surface of the discharge channel; and a liquid absorbing material configured to receive liquid ejected from the liquid ejecting head and configured to be stored in the interior of the cap, the liquid absorbing material comprising:

a body portion to be arranged in the interior of the cap when being stored in the cap, and a projecting portion arranged in the discharge channel, wherein the discharge channel is configured to receive a sucking force from an external pump for discharging the liquid.

2. The cap device according to claim 1, wherein the projecting portion is arranged in a state of being fitted in the discharge channel.

3. The cap device according to claim 1, wherein the projecting portion is adapted at least to be resiliently deformable, and to be inserted into the discharge channel in a compressed state.

4. The cap device according to claim 1, wherein the discharge channel and the atmosphere opening channel are arranged on a side portion of the cap so as to oppose to each other, and the atmosphere opening channel is connected linearly to an end portion of the recessed groove on the side of the atmosphere opening channel in a communicating state.

5. The cap device according to claim 4 comprising: a shoulder provided between a bottom surface in the discharge channel and the bottom surface in the cap so that the bottom surface in the discharge channel is higher than the bottom surface in the cap.

6. The cap device according to claim 5, wherein the shoulder is adjacent to an end of the recessed groove on the discharge channel side.

7. The cap device according to claim 1, wherein the projecting portion does not extend through the entire length of the discharge channel.

8. A liquid ejecting apparatus comprising:

a liquid ejecting head for ejecting liquid; and the cap device according to claim 1.

9. A cap device comprising:

a seal portion that is configured to come into abutment with a liquid ejecting head of a liquid ejection apparatus that includes the cap device so as to cover nozzle openings of the liquid ejecting head that eject liquid;

a liquid absorbing material comprising a body portion arranged in the cap device when being stored in the cap device and a projecting portion, the liquid absorbing material configured to receive liquid ejected from the liquid ejecting head;

a discharge channel for discharging liquid in the interior thereof, wherein the projecting portion is arranged in the discharge channel;

a recessed groove extending toward the discharge channel on a bottom surface of the cap device; and an atmosphere opening channel for opening the interior of the cap device to the atmosphere, wherein the atmosphere opening channel is connected linearly to an end portion of the recessed groove on the side of the atmosphere opening channel in a communicating state, wherein the bottom surface of the cap device includes a step portion that causes the bottom surface to be lower than a bottom surface of the discharge channel.

* * * * *